US009206639B2

(12) United States Patent
Chen

(10) Patent No.: US 9,206,639 B2
(45) Date of Patent: Dec. 8, 2015

(54) POSITIONING DEVICE OF WINDOW COVERING

(71) Applicant: NIEN MADE ENTERPRISE CO., LTD., Taichung (TW)

(72) Inventor: Lin Chen, Taichung (TW)

(73) Assignee: NIEN MADE ENTERPRISE CO., LTD., Taichung (TW)

( * ) Notice: Subject to any disclaimer, the term of this patent is extended or adjusted under 35 U.S.C. 154(b) by 0 days.

(21) Appl. No.: 14/287,566

(22) Filed: May 27, 2014

(65) Prior Publication Data

US 2014/0374038 A1 Dec. 25, 2014

(30) Foreign Application Priority Data

Jun. 21, 2013 (CN) ..... 2013 2 0358114 U

(51) Int. Cl.

| | |
|---|---|
| ***A47H 5/00*** | (2006.01) |
| ***E06B 9/324*** | (2006.01) |
| ***E06B 9/325*** | (2006.01) |
| ***E06B 9/388*** | (2006.01) |
| *A47H 3/10* | (2006.01) |
| *E06B 9/382* | (2006.01) |
| *E06B 9/262* | (2006.01) |
| *A47H 3/00* | (2006.01) |
| *A47H 3/02* | (2006.01) |
| *A47H 3/06* | (2006.01) |

(52) U.S. Cl.

CPC ..... *E06B 9/324* (2013.01); *E06B 9/262* (2013.01); *E06B 9/325* (2013.01); *E06B 9/388* (2013.01); *A47H 3/00* (2013.01); *A47H 3/02* (2013.01); *A47H 3/06* (2013.01); *A47H 3/10* (2013.01); *E06B 9/382* (2013.01); *E06B 2009/2622* (2013.01); *E06B 2009/2625* (2013.01); *E06B 2009/2627* (2013.01)

(58) Field of Classification Search

CPC ..... F16G 11/04; F16G 11/02; F16G 11/00; F16G 11/10; F16G 11/044; F16G 11/101; E06B 9/324; E06B 9/325; E06B 9/382; E06B 9/262; E06B 2009/2622; E06B 2009/2625; E06B 2009/2627; A47H 3/00; A47H 3/02; A47H 3/06

USPC .. 24/134 KB, 134 R, 132 WL, 136 B, 135 R, 24/115 R; 160/370, 84.01, 84.04, 84.05, 160/84.06

See application file for complete search history.

(56) References Cited

U.S. PATENT DOCUMENTS

| | | | | | |
|---|---|---|---|---|---|
| 362,173 | A | * | 5/1887 | Nudd | 182/5 |
| 2,471,503 | A | * | 5/1949 | Ward et al. | 24/134 P |
| 2,845,674 | A | * | 8/1958 | Pearson | 24/134 KB |
| 3,926,278 | A | * | 12/1975 | Molnar et al. | 182/7 |
| 4,217,847 | A | * | 8/1980 | McCloud | 114/218 |
| 4,453,486 | A | * | 6/1984 | Harken | 114/218 |

(Continued)

*Primary Examiner* — Katherine Mitchell
*Assistant Examiner* — Johnnie A Shablack
(74) *Attorney, Agent, or Firm* — Ming Chow; Sinorica, LLC

(57) ABSTRACT

A positioning device for a window covering includes a base, two clamping members, and an operating member. The base has a main recess and a cord bore, and the cord bore is communicated with main recess, and a cord is inserted into the cord bore and passes through the main recess. The clamping members are movably received in the main recess of the base, and the cord passes through a space between the clamping members. The operating member is connected to the base for rotation to drive the clamping members to move. While the operating member is turned, the clamping members will be moved toward each other to clamp the cord.

6 Claims, 9 Drawing Sheets

(56) References Cited

U.S. PATENT DOCUMENTS

| | | | | |
|---|---|---|---|---|
| 4,635,698 | A * | 1/1987 | Anderson | 160/178.2 |
| 4,674,722 | A * | 6/1987 | Danby et al. | 248/231.31 |
| 4,811,466 | A * | 3/1989 | Zubli | 24/115 G |
| 5,352,172 | A * | 10/1994 | Suzaki | 482/120 |
| 5,365,641 | A * | 11/1994 | Watanabe et al. | 24/115 G |
| 6,029,734 | A * | 2/2000 | Wang et al. | 160/170 |
| 6,058,575 | A * | 5/2000 | Dagan | 24/136 R |
| 6,085,823 | A * | 7/2000 | Oskam | 160/172 R |
| 6,279,208 | B1 * | 8/2001 | Gillis | 24/343 |
| 6,283,191 | B1 * | 9/2001 | Lo | 160/84.02 |
| 6,327,751 | B1 * | 12/2001 | Ikeda | 24/115 G |
| 6,443,207 | B1 * | 9/2002 | Cheng et al. | 160/84.04 |
| 6,575,223 | B1 * | 6/2003 | Chung et al. | 160/170 |
| 6,823,925 | B2 * | 11/2004 | Militello et al. | 160/170 |
| 7,096,917 | B2 * | 8/2006 | Ciuca et al. | 160/170 |
| 7,117,919 | B2 * | 10/2006 | Judkins | 160/170 |
| 7,168,476 | B2 * | 1/2007 | Chen | 160/170 |
| 7,191,817 | B2 * | 3/2007 | Nicolosi | 160/84.06 |
| 7,287,303 | B2 * | 10/2007 | Yang | 24/134 R |
| 7,320,354 | B2 * | 1/2008 | Cheng | 160/170 |
| 7,373,965 | B2 * | 5/2008 | Cheng | 160/178.2 |
| 7,575,036 | B2 * | 8/2009 | Cheng | 160/170 |
| 8,245,360 | B2 * | 8/2012 | Stafford et al. | 24/136 R |
| 8,794,296 | B2 * | 8/2014 | Shih et al. | 160/168.1 R |
| 8,887,786 | B2 * | 11/2014 | Anderson et al. | 160/84.03 |
| 8,935,832 | B2 * | 1/2015 | Chuang | 24/115 G |
| 2006/0196612 | A1 * | 9/2006 | Strand et al. | 160/84.05 |
| 2007/0023151 | A1 * | 2/2007 | Judkins | 160/170 |
| 2007/0151676 | A1 * | 7/2007 | Lin | 160/170 |
| 2009/0159373 | A1 * | 6/2009 | Hartman et al. | 187/350 |
| 2011/0107557 | A1 * | 5/2011 | Bourke et al. | 24/115 R |
| 2012/0060329 | A1 * | 3/2012 | Zhang | 24/115 F |
| 2013/0233500 | A1 * | 9/2013 | Chen | 160/370 |
| 2014/0048220 | A1 * | 2/2014 | Cheng | 160/368.1 |
| 2014/0076504 | A1 * | 3/2014 | Anthony et al. | 160/84.04 |
| 2014/0374034 | A1 * | 12/2014 | Corey et al. | 160/170 |
| 2014/0374038 | A1 * | 12/2014 | Chen | 160/370 |
| 2015/0020980 | A1 * | 1/2015 | Franssen | 160/84.01 |
| 2015/0068689 | A1 * | 3/2015 | Zhang | 160/178.2 |
| 2015/0075729 | A1 * | 3/2015 | Anderson et al. | 160/193 |

* cited by examiner

POSITIONING DEVICE OF WINDOW COVERING

The current application claims a foreign priority to the patent application of China No. 201320358114.4 filed on Jun. 21, 2013.

BACKGROUND OF THE INVENTION

1. Field of the Invention

The present invention relates generally to a window covering, and more particularly to a positioning device of a cordless window covering or a cellular shade.

2. Description of the Related Art

A conventional cordless window covering includes two rails and a valance with opposite ends connected to the rails. Two cords are provided to connect the rails to change vertical positions of the rails respectively, and therefore the valance is folded or unfolded.

In order to fasten the rails to the cords while they are moved to the desired vertical positions, a conventional way is providing two bores on each rail for the cords to pass through. These bores are not aligned with bores on the rails, through which the cords pass, so that the cords will be rested against sidewalls of the bores to generate frictions. The frictions are proportional to a weight of the valance. The frictions may hold the rails on the cords. It is easy to under that the structure and the strength of the rail would be worn out fast because of the bores and the pressures of the cords. An improved design is to provide two cord clamping devices on the rail to connect the cords. The cord clamping device can slow the wear out of the rails, however, the problem of cord wearing still exists. The worn cords will have difficulty to hold the rails.

SUMMARY OF THE INVENTION

The primary objective of the present invention is to provide a positioning device of a window covering, which holds the rail at any desired vertical position without the aforesaid drawbacks.

According to the objective of the present invention, a positioning device for a window covering includes a base, a first clamping member, a second clamping member, and an operating member. The base is connected to the rail of the window covering, and has a main recess and a cord bore, wherein the cord bore is communicated with main recess, and the cord is inserted into the cord bore and passes through the main recess. The first clamping member is movably received in the main recess of the base, and having a first driven cam portion. The second clamping member is received in the main recess of the base, wherein the cord passes through a space between the first clamping member and the second clamping member. The operating member is connected to the base for rotation, and has a first guiding post received in the main recess of the base, wherein the first guiding post has a first driving cam portion resting against the first driven cam portion of the first clamping member. The first clamping member is moved toward the second clamping member to clamp the cord while the operating member is turned.

In an embodiment, the base has a main board and two clamping boards at a top end and a bottom end of the main board respectively; the main board has the main recess and a guiding slot on the main recess; the operating member is connected to a side of the main board opposite to the main recess, and the first guiding post is inserted into the guiding slot and enters the main recess; the cord bore extends from the top end to the bottom end of the main board.

In an embodiment, the main board is provided with an annular wall at the side opposite to the main recess; the annular wall is provided with a plurality of locking slots at an inner side thereof; the operating member has an inner ring, on which a protrusion is provided; the protrusion engages one of the locking slots while the operating member is turned.

In an embodiment, the main board further has a bore on one side of the main recess; the first clamping member has a first post received the bore; the first guiding slot is a curved slot, and the first driven cam portion is a curved surface corresponding to the first guiding slot.

In an embodiment, the main board is provided with an annular wall at the side opposite to the main recess; the annular wall is provided with a protrusion at an outer side thereof; the operating member has a plurality of locking slots to engage the protrusion while the operating member is turned.

In an embodiment, the second clamping member is movably received in the main recess of the operating member, and has a second driven cam portion; the operating member is provided with a second guiding post received in the main recess of the operating member; the second guiding post is provided with a second driving cam portion resting against the second driven cam portion of the second clamping member; the second clamping member is moved toward the first clamping member to clamp the cord while the operating member is turned.

Therefore, the clamping members would clamp the cord by turning the operating member to hold the rail at the current position.

DETAILED DESCRIPTION OF THE INVENTION

The detailed description and technical contents of the present invention will be explained with reference to the accompanying drawings. However, the drawings are illustrative only but shall not be used to limit the present invention.

Figure 1:
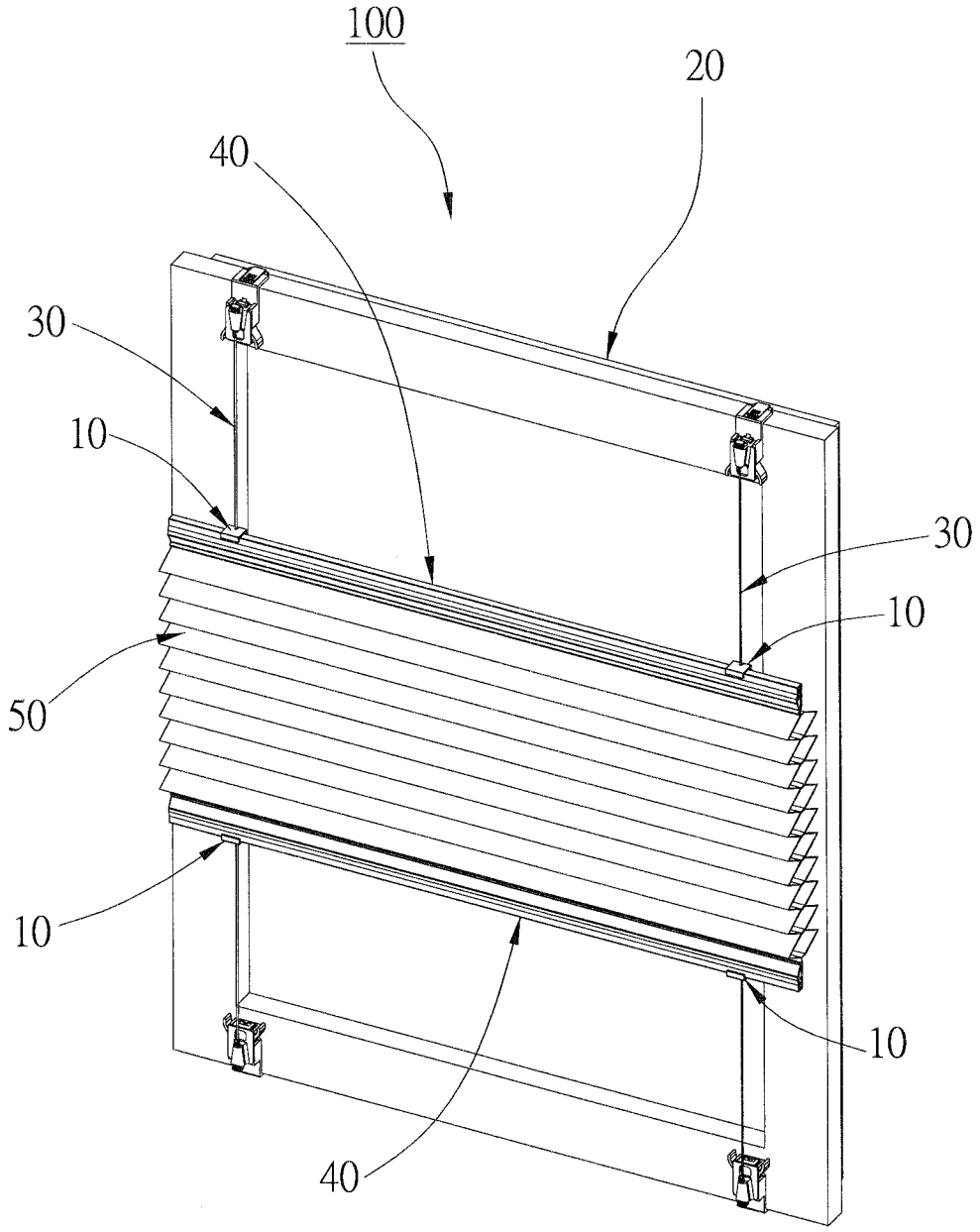
FIG. 1 is a perspective view of the window covering with a first preferred embodiment of the present invention.
Figure 2:
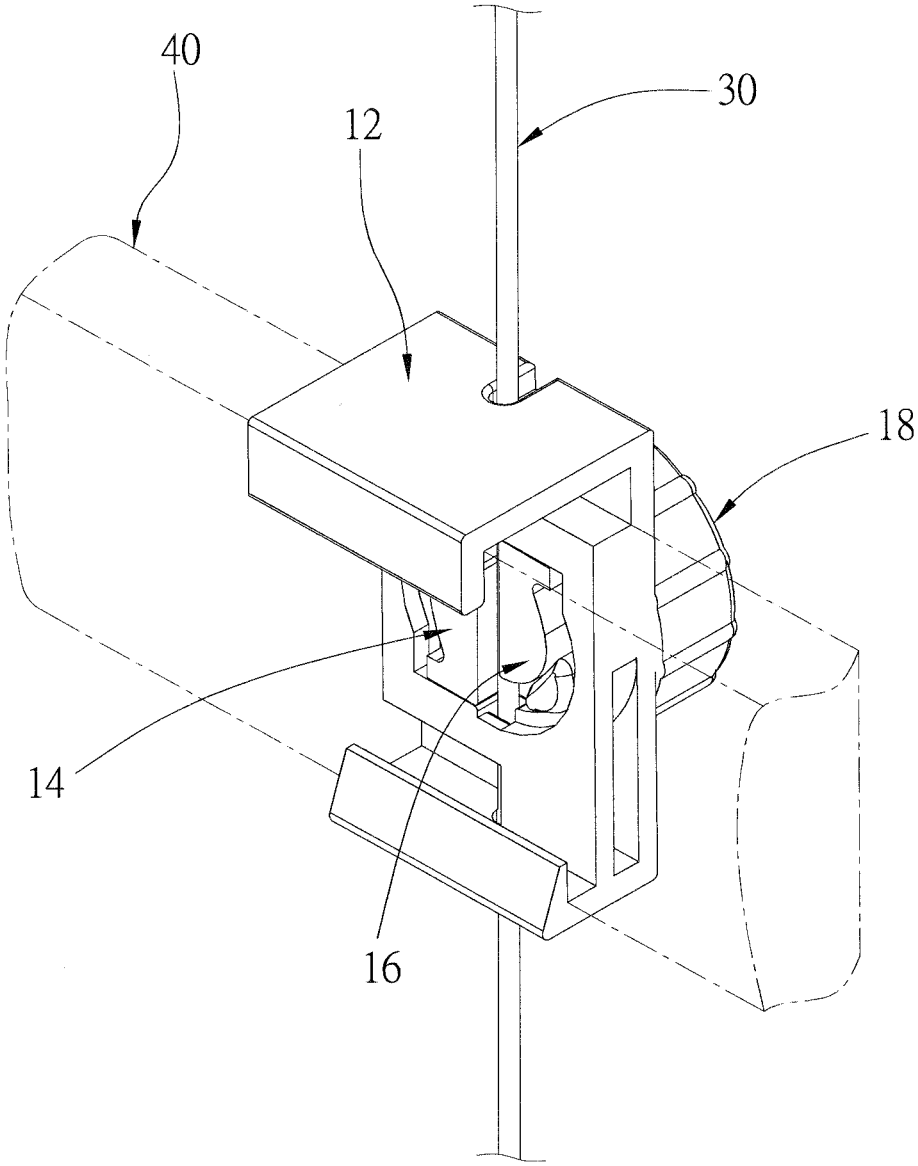
FIG. 2 is a perspective view of the positioning device of the first preferred embodiment of the present invention.
Figure 3:
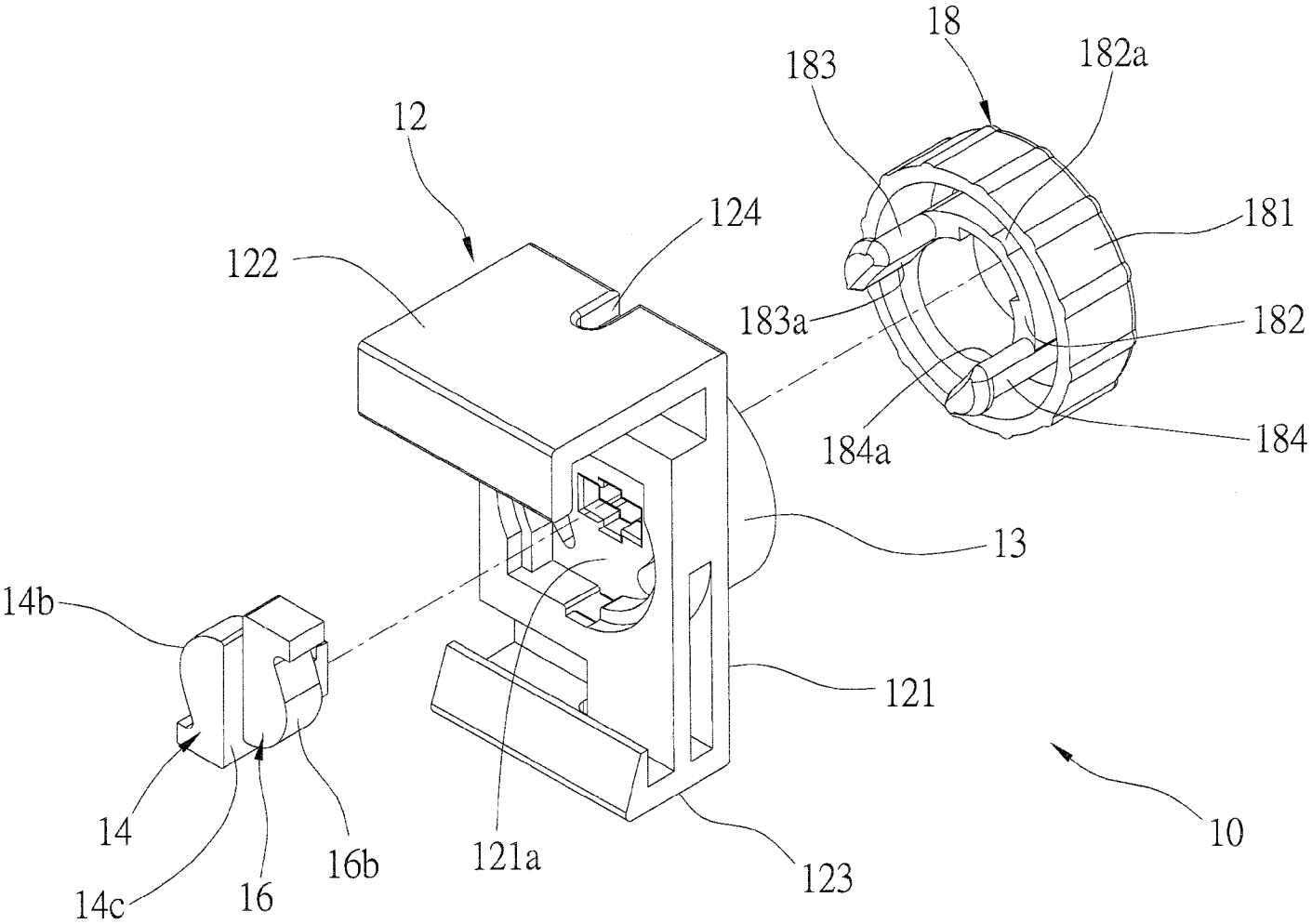
FIG. 3 is an exploded view of the positioning device of the first preferred embodiment of the present invention.
Figure 4:
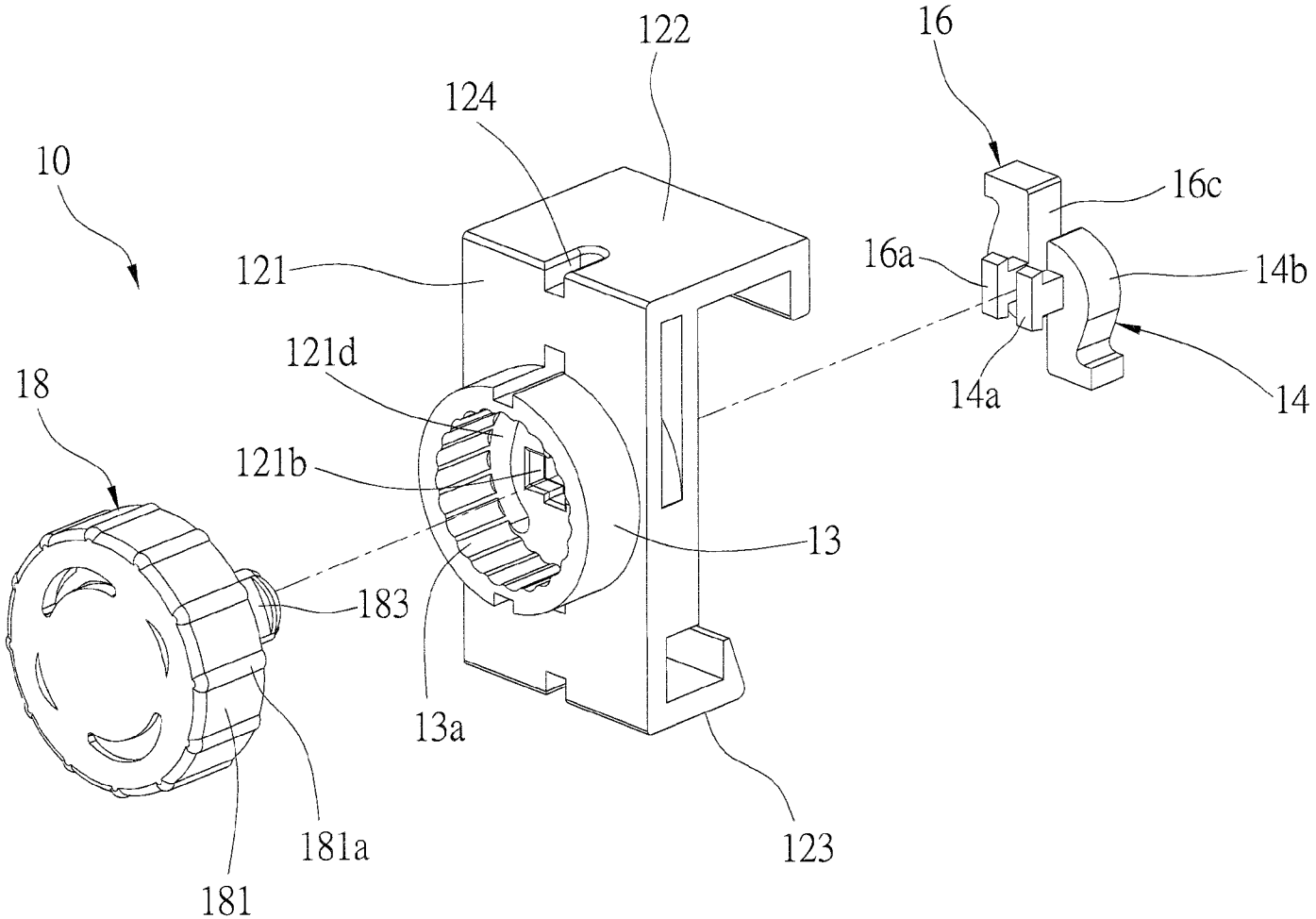
FIG. 4 is another exploded view of the positioning device.

FIG. 1 shows a window covering 100 of the first preferred embodiment of the present invention, which includes a frame 20, two cords 30 with opposite ends connected to the frame 20, two rails 40, through which the cords 30 pass, two positioning device 10, and a valance 50. The valance 50 is shown as a honeycomb shades in the figures. As shown in FIG. 2 to FIG. 4, each positioning device 10 includes a base 12, a first clamping member 14, a second clamping member 16, and an operating member 18.

Figure 5:
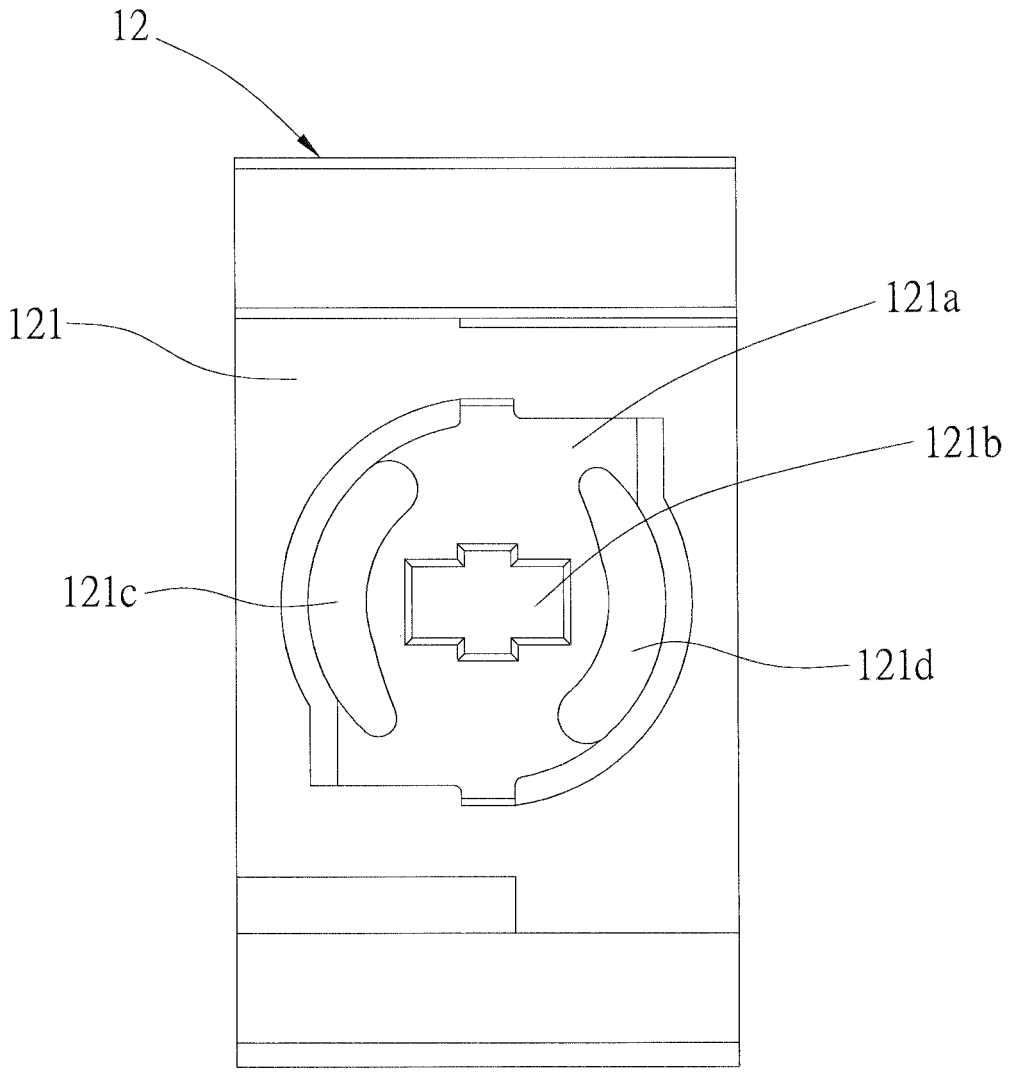
FIG. 5 is a front view of the base of the positioning device of the first preferred embodiment of the present invention.

The base 12 has a main board 121 and two clamping boards 122, 123. As shown in FIG. 5, the main board 121 is provided with a main recess 121*a*, a bore 121*b*, a first guiding slot 121*c*, and a second guiding slot 121*d*. The main recess 121*a* is provided on a side of the main board 121, the bore 121*b* is a cross through hole on a center of the main recess 121*a*, the first and the second guiding slots 121*c* and 121*d* are two symmetrical curved slots on the main recess 121*a*, and the bore 121*b* is between the first and the second guiding slots 121*c* and 121*d*.

The clamping boards 122 and 123 have ends connected to a top end and a bottom end of the main board 121 respectively, and are vertical to the main board 121. At a distal end of each clamping board 122 a hook is provided which allows the base 12 to be connected with the rail 40. The main board 121 is provided with a cord bore 124 extending from the top end to the bottom end. The cord bore 124 is communicated with the main recess 121*a*. The cord 30 is inserted into the cord bore 124, and passes through the main recess 121*a*. The main board 121 is provided with an annular wall 13 on a side opposite to the main recess 121*a*, and the bore 121*b* is within the annular wall 13. The annular wall 13 is provided with a plurality of locking slots 13*a* at an inner side thereof, and the locking slots 13*a* are parallel to each other and open at a distal end of the annular wall 13.

Figure 6:
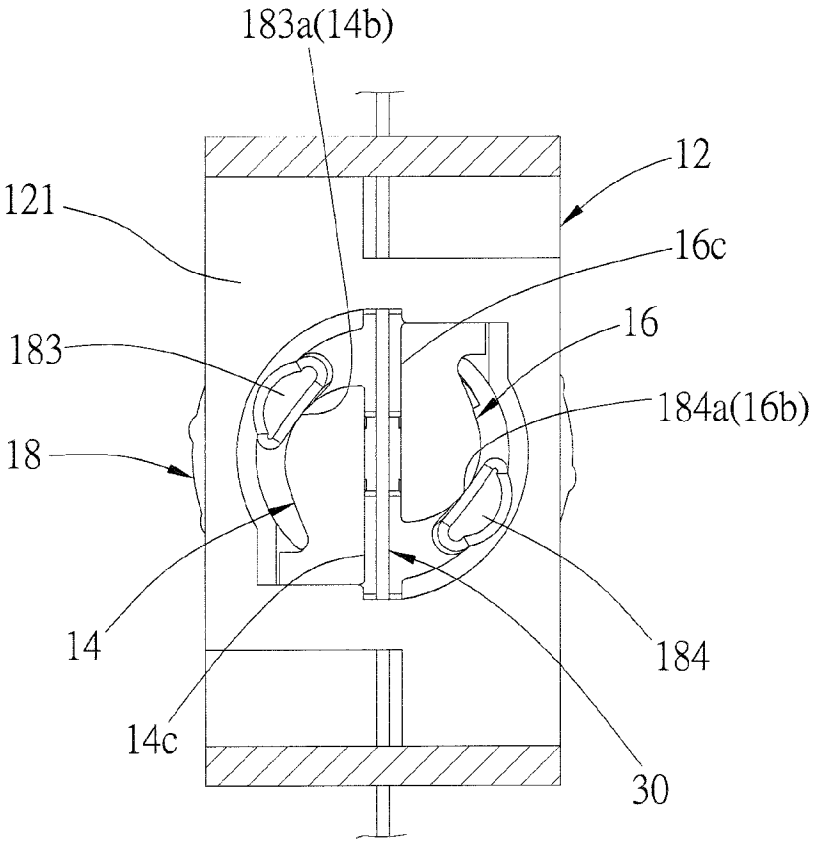
FIG. 6 is a sectional view of the positioning device of the first preferred embodiment of the present invention, showing the clamping members releasing the cord.

The first clamping member 14 and the second clamp member 16 are the same in the present embodiment. The first clamping member 14 has a T-shaped first post 14*a*, and the second clamp member 16 has a T-shaped second post 16*a*, and both the posts 14*a*, 16*b* are received in the bore 121*b* to engage the first clamping member 14 and the second clamp member 16 with the base 12 and allow them to move in the bore 121*b*. The rest parts of the first clamping member 14 and the second clamp member 16 are received in the main recess 121*a*. The first clamping member 14 has a first driven cam portion 14*b* and a first clamping portion 14*c*, and the second clamp member 16 has a second driven cam portion 16*b* and a second clamping portion 16*c*, wherein the driven cam portions 14*b*, 16*b* are two curved surfaces corresponding to the guiding slots 121*c* and 121*d* respectively, and the clamping portions 14*c*, 16*c* are two flat surfaces facing each other. As shown in FIG. 6, the cord 30 passes through a space between the clamping portions 14*c*, 16*c* of the clamping members 14, 16.

The operating member 18 includes a knob 181, an inner ring 182, a first guiding post 183, and a second guiding post 184. The knob 181 has a disk and an outer ring on an edge of the disk, and the outer ring has teeth 181*a* to increase friction while the user holds and turns the knob 181. The inner ring 182 is distanced from an inner side of the knob 181, and parallel to the outer ring. The inner ring 182 has a protrusion 182*a* on an outer side thereof, and the protrusion 182*a* faces the outer ring. The first guiding post 183 and the second guiding post 184 are projected from a distal end of the inner ring 182. The first guiding post 183 and the second guiding post 184 are inserted into the first guiding slot 121*c* and the second guiding slot 121*d* of the base 12 respectively, and distal ends of the first guiding post 183 and the second guiding post 184 enter the main recess 121*a*. The first clamping member 14 and the second clamp member 16 are between the first guiding post 183 and the second guiding post 184. The first guiding post 183 has a first driving cam portion 183*a* resting against the first driven cam portion 14*b* of the first clamping member 14, and the second guiding post 184 has a second driving cam portion 184*a* resting against the second driven cam portion 16*b* of the second clamping member 16.

The inner ring 182 of the operating member 18 is received within the annular wall 13, and the protrusion 182*a* engages one of the locking slots 13*a* while the knob 181 is turned by user to hold the operating member 18 at a certain position.

Figure 7:
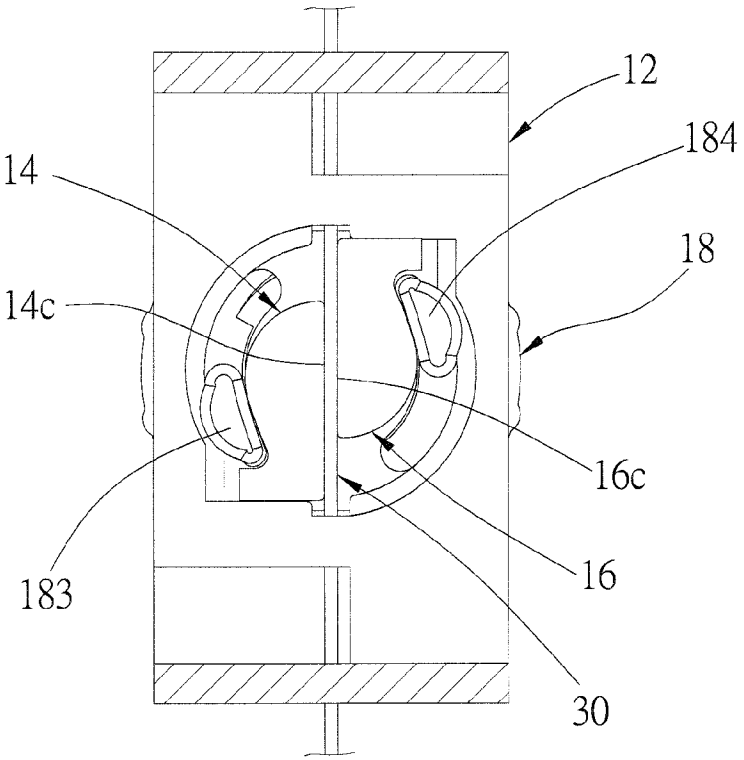
FIG. 7 is a sectional view of the positioning device of the first preferred embodiment of the present invention, showing the clamping members clamping the cord.

As shown in FIG. 6, while the operating member 18 is turned to move the guiding posts 183, 184 to one ends of the driven cam portions 14*b*, 16*b* of the clamping members 14, 16 respectively, a width of the space between the clamping portions 14*c*, 16*c* is big, and the cord 30 is not clamped by the clamping members 14, 16. As shown in FIG. 7, while the operating member 18 is turned to move the first guiding posts 183, 184 toward middles of the driven cam portions 14*b*, 16*b* respectively, the first clamping member 14 and the second driven cam portion 16*b* will be moved toward each other, and the clamping portions 14*a*, 16*a* of the clamping members 14, 16 press the cord 30 to clamp the cord 30. While the first guiding post 183 and the second guiding post 184 arrive at the middles of the driven cam portions 14*b*, 16*b* (the highest portions), the clamping force of the clamping members 14, 16 would be the largest. In other words, the clamping force on the cord 30 would be adjusted by turning the operating member 18. With the engagement of the protrusion 182*a* and the locking slot 13*a*, it may maintain the first guiding post 183 and the second guiding post 184 at the present positions even when the cord 30 is pulled.

Figure 8:
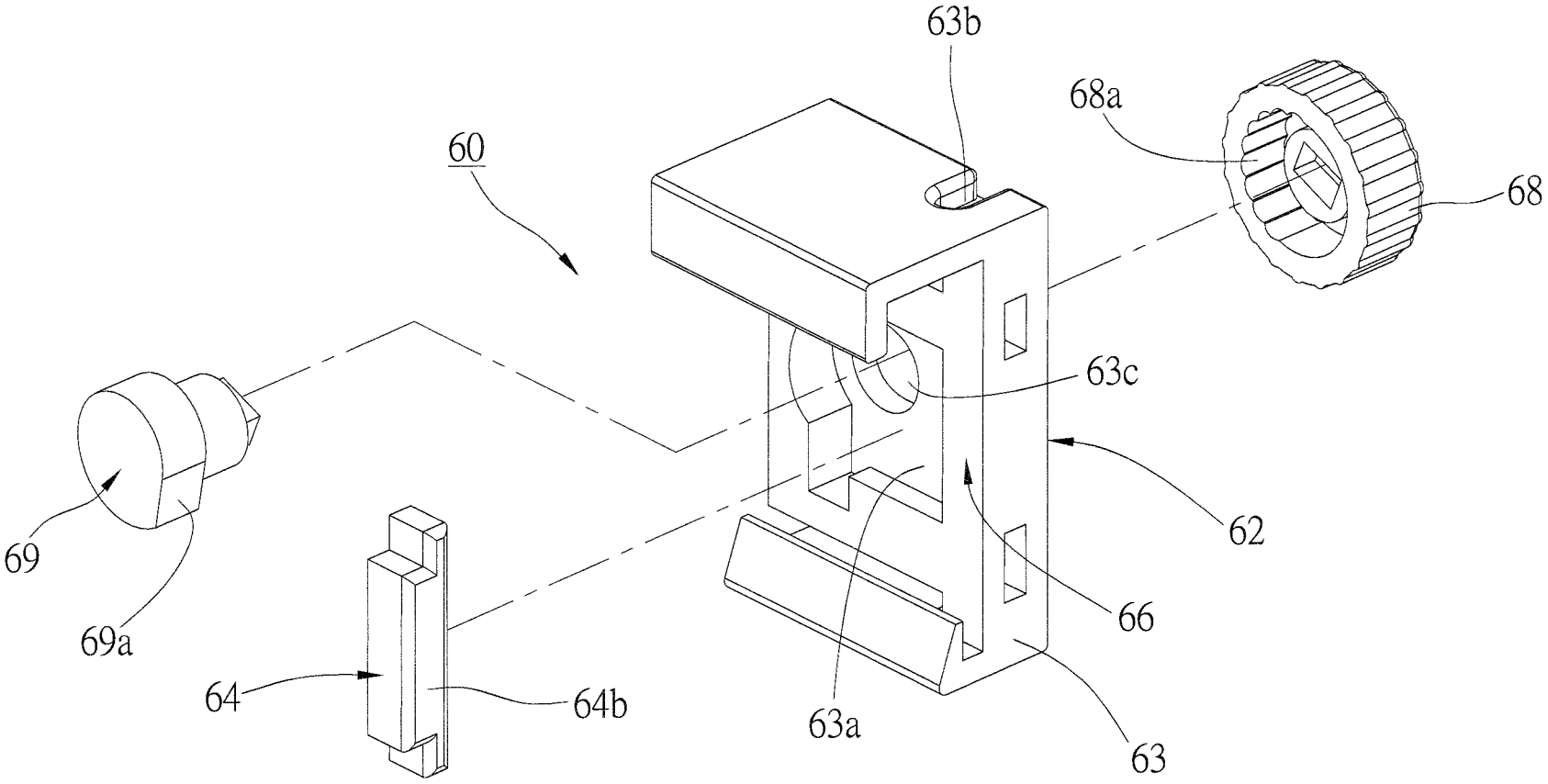
FIG. 8 is an exploded view of the positioning device of a second preferred embodiment of the present invention.
Figure 9:
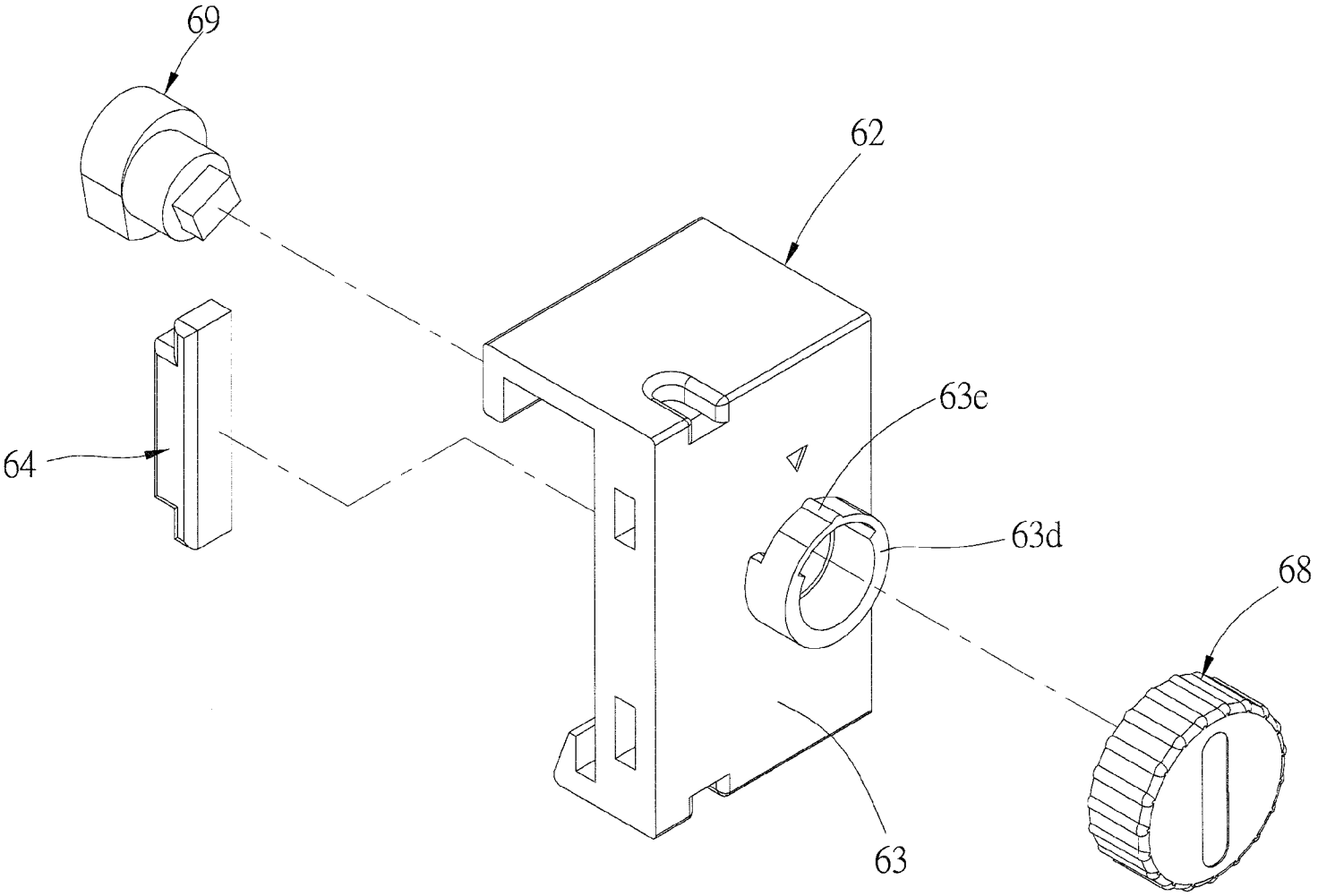
FIG. 9 is another exploded view of the positioning device.
Figure 10:
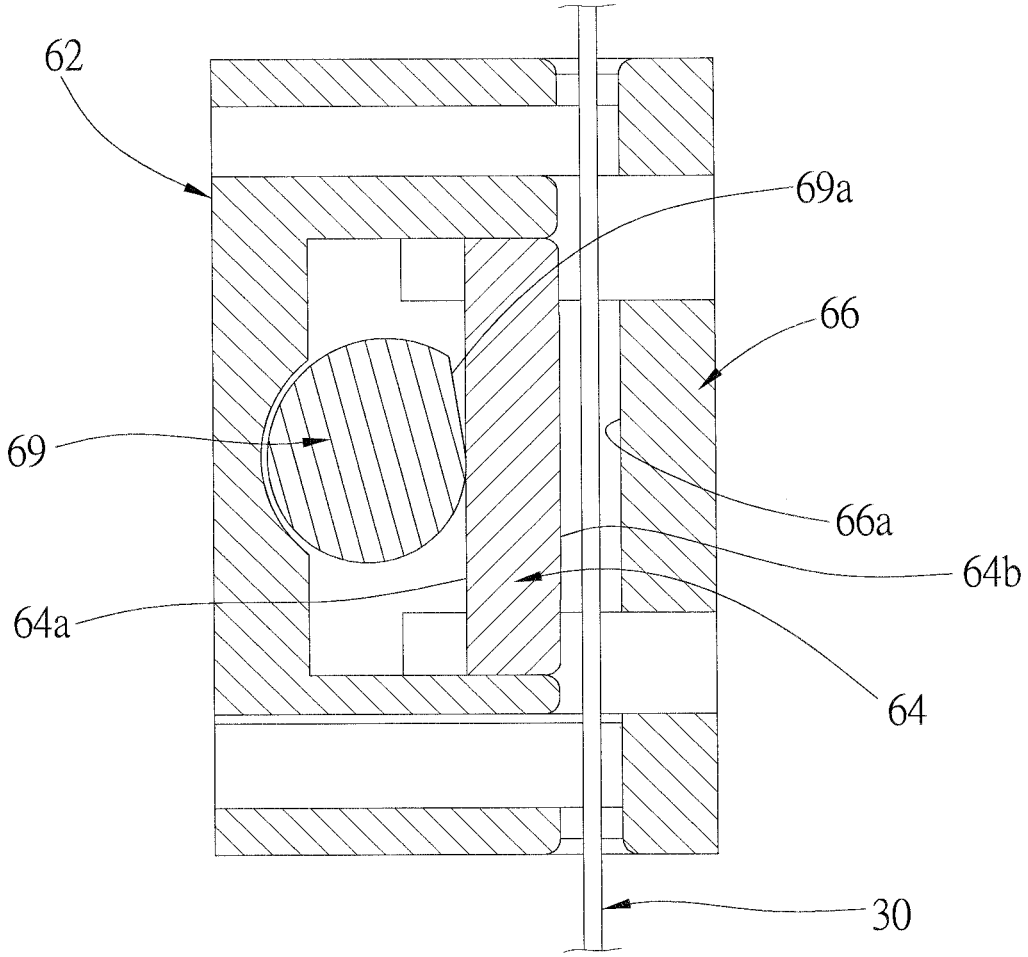
FIG. 10 is a sectional view of the positioning device of the second preferred embodiment of the present invention, showing the clamping members releasing the cord.

As shown in FIG. 8 to FIG. 10, a positioning device 60 of the second preferred embodiment of the present invention includes a base 62, a first clamping member 64, a second clamping member 66, and an operating member. The base 62 has a main board 63, on which a main recess 63*a*, a cord bore 63*b*, and a first guiding slot 63*c* are provided. The cord bore 63*b* extends from a top end and a bottom end of the main board 63, and is communicated with the main recess 63*a*. The first guiding slot 63*c* is on the main recess 63*a*, and is open at opposite sides of the main board 63. The first clamping member 64 is received in the main recess 63*a* for reciprocation, and has a first driven cam portion 64*a* and a first clamping portion 64*b*. In the present embodiment, the second clamping member 66 is a part of the main board 63, in other words, it is fixed. The second clamping member 66 has a second clamping portion 66*a* facing the first clamping portion 64*b*. The cord 30 is inserted into the cord bore 63*b* and passes through a space between the clamping portions 64*b*, 66*a* of the clamping members 64, 66. The operating member has a knob 68 and a first guiding post 69. The first guiding post 69 is inserted into the first guiding slot 63*c*, and has a first driving cam portion 69*a*. The first driving cam portion 69*a* rests against the first driven cam portion 64*a* of the first clamping member 64 to move the first clamping member 64 while the knob 68 is turned. In the present embodiment, the first driving cam portion 69*a* is a circumference with a flat section, and while the knob 68 is turned to have the flat section facing the first driven cam portion 64*a*, it makes the first clamping member 64 no longer press the cord 30 to release the cord 30. On the contrary, while the knob 68 is turned to have the rest part of the first driving cam portion 69*a* facing the first driven cam portion 64*a*, it makes the first clamping member 64 press the cord 30 to clamp the cord 30. The main board 63 is provided with an annular wall 63*d* at a side opposite to the main recess 63*a*, and the first guiding slot 63*c* is within the annular wall 63*d*. The annular wall 63*d* is provided with a protrusion 63*e* on an outer side thereof, and the knob 68 is provided with locking slots 68*a* on an inner side thereof. The protrusion 63*e* engages one of the locking slots 68*a* while the knob 68 is turned to temporarily hold knob 68.

The description above is only a few preferred embodiments of the present invention and the equivalence of the present invention is still in the scope of claim construction of the present invention.

What is claimed is:

1. A positioning device for a window covering, wherein the window covering has a rail and a cord, comprising:

a base, which is connected to the rail of the window covering, having a main recess and a cord bore, wherein the cord bore is communicated with main recess, and the cord is inserted into the cord bore and passes through the main recess;

a first clamping member movably received in the main recess of the base, and having a first driven cam portion;

a second clamping member received in the main recess of the base, wherein the cord passes through a space between the first clamping member and the second clamping member;

an operating member connected to the base for rotation, and having a first guiding post received in the main recess of the base, wherein the first guiding post has a first driving cam portion; and wherein the first driving cam portion is resting against and sliding on the first driven cam portion to move the first clamping member in a lateral direction towards the second clamping member to clamp the cord between the first clamping member and the second clamping member, while the operating member is turned.

2. The positioning device as defined in claim 1, wherein the second clamping member is movably received in the main recess of the operating member, and has a second driven cam portion; the operating member is provided with a second guiding post received in the main recess of the operating member; the second guiding post is provided with a second driving cam portion resting against the second driven cam portion of the second clamping member; the second clamping member is moved toward the first clamping member and the first clamping member is moved toward the second clamping member to clamp the cord while the operating member is turned.

3. The positioning device as defined in claim 1, wherein the base has a main board and two clamping boards at a top end and a bottom end of the main board respectively; the main board has the main recess and a guiding slot on the main recess; the operating member is connected to a side of the main board opposite to the main recess, and the first guiding post is inserted into the guiding slot and enters the main recess; the cord bore extends from the top end to the bottom end of the main board.

4. The positioning device as defined in claim 3, wherein the main board is provided with an annular wall at the side opposite to the main recess; the annular wall is provided with a protrusion at an outer side thereof; the operating member has a plurality of locking slots to engage the protrusion while the operating member is turned.

5. The positioning device as defined in claim 3, wherein the main board is provided with an annular wall at the side opposite to the main recess; the annular wall is provided with a plurality of locking slots at an inner side thereof; the operating member has an inner ring, on which a protrusion is provided; the protrusion engages one of the locking slots while the operating member is turned.

6. The positioning device as defined in claim 5, wherein the main board further has a bore on the main recess; the first clamping member has a first post received in the bore; the guiding slot is a curved slot, and the first driven cam portion is a curved surface corresponding to the guiding slot.

* * * * *